US011137188B2

(12) United States Patent
Yang

(10) Patent No.: US 11,137,188 B2
(45) Date of Patent: Oct. 5, 2021

(54) ICE MAKER AND REFRIGERATOR HAVING SAME

(71) Applicant: Daewoo Electronics Corporation, Gwangju (KR)

(72) Inventor: Sung Jin Yang, Incheon (KR)

(73) Assignee: Daewoo Electronics Corporation, Gwangju (KR)

( * ) Notice: Subject to any disclaimer, the term of this patent is extended or adjusted under 35 U.S.C. 154(b) by 151 days.

(21) Appl. No.: 16/388,679

(22) Filed: Apr. 18, 2019

(65) Prior Publication Data

US 2019/0331383 A1 Oct. 31, 2019

(51) Int. Cl.
*F25C 1/25* (2018.01)
*F25C 5/185* (2018.01)
*F25C 1/04* (2018.01)

(52) U.S. Cl.
CPC ..... *F25C 1/25* (2018.01); *F25C 1/04* (2013.01); *F25C 5/185* (2013.01)

(58) Field of Classification Search
CPC ..... F25C 1/25; F25C 2500/06; F25C 5/185
USPC ..... 62/344
See application file for complete search history.

(56) References Cited

U.S. PATENT DOCUMENTS

| | | | | |
|---|---|---|---|---|
| 10,480,845 | B2 * | 11/2019 | Yang | F25C 1/25 |
| 2011/0185759 | A1 * | 8/2011 | Kang | F25C 5/22 62/340 |
| 2016/0370090 | A1 * | 12/2016 | Yang | F25C 5/182 |
| 2019/0041112 | A1 * | 2/2019 | Chatelle | F25C 1/10 |

FOREIGN PATENT DOCUMENTS

| | | | |
|---|---|---|---|
| CN | 101960241 | A | 1/2011 |
| CN | 107345721 | A | 11/2017 |
| JP | 2016085011 | A | 5/2016 |

OTHER PUBLICATIONS

Office Action dated Oct. 20, 2020; Chinese Application No. 201910149325.9; 8 pgs.; Chinese National Intellectual Property Administration, Beijing, China.

* cited by examiner

*Primary Examiner* — Henry T Crenshaw
(74) *Attorney, Agent, or Firm* — Central California IP Group P.C.; Andrew D. Fortney

(57) ABSTRACT

The present invention relates to an ice maker and a refrigerator having the same. The refrigerator includes a main body having a storage room therein; a door on the main body, configured to open and close the storage room; and an ice maker in the storage room, wherein the ice maker includes an ice tray configured to contain water; a guide unit under the ice tray, forming a path for flowing cold air; an ice bucket under the guide unit, including a container having a concave center portion; a rotation unit configured to move the ice in the ice tray to the ice bucket; and a cover unit configured to cover the ice tray and having a water supply unit configured to supply water to the ice tray. The water supply unit includes a first communication hole in the cover; a water supply wall on one side of the ice tray; a second communication hole communicating with the first communication hole and configured to discharge the water, and a rib or flange on the water supply wall, configured to shield part of the second communication hole.

11 Claims, 6 Drawing Sheets

ICE MAKER AND REFRIGERATOR HAVING SAME

TECHNICAL FIELD

The present invention relates to an ice maker and a refrigerator having the same.

BACKGROUND

A refrigerator is an apparatus for storing food at a low temperature. The refrigerator can be configured to store the food in a frozen or refrigerated state according to the type of food to be stored. The inside of the refrigerator is cooled down by continuously supplied cold air, and the cold air is continuously generated by the heat exchange action of a refrigerant by way of a refrigeration cycle going through the process of compression, condensation, expansion and evaporation. Since the cold air supplied to the inside of the refrigerator is evenly delivered inside the refrigerator owing to convection, the food inside the refrigerator can be stored at a desired temperature.

An ice maker may be provided in the refrigerator for the convenience of use. The ice maker may make ice by supplying cold air to water and storing a predetermined amount of ice. The ice maker may include an ice making tray for making ice, an ice storage unit for storing the ice made by the ice making tray, and a cover unit for protecting the ice making tray.

A water supply unit for supplying water to the ice making tray may be in or under the cover unit. The water supply unit may include a fluid passage for supplying water to the ice making tray. A defect in the water supply, such as a water leak in the water supply unit (e.g., to the outside of the ice making tray) may occur due to excess water pressure.

SUMMARY

An object of the present invention is to provide an ice maker that can effectively make ice, and a refrigerator having the same.

In addition, another object of the present invention is to provide an ice maker that can prevent a water supply defect, and a refrigerator having the same.

In accordance with an aspect of the present invention, there is provided a refrigerator comprising a main body, configured having a storage room therein; a door on the main body to open and close the storage room; and an ice maker in the storage room, wherein the ice maker includes an ice tray configured to contain water; a guide unit under the ice tray, forming a path for flowing cold air; an ice bucket under the guide unit, comprising a container having a concave center portion; a rotation unit configured to move the ice in the ice tray to the ice bucket; and a cover unit configured to cover a top of the ice tray and having a water supply unit configured to supply water to the ice tray, wherein the water supply unit includes a first communication hole communicating with one side of a case; a water supply wall at a location corresponding to one side of the ice tray; a second communication hole communicating with the first communication hole and configured to discharge the water, and one or more ribs or flanges on the water supply wall, configured to shield part of the second communication hole.

The rib(s) may have an area smaller than that of the second communication hole, and may protrude from the water supply wall toward the second communication hole.

The rib(s) may be configured to shield opposite sides of the second communication hole, and the rib or flange may be configured to discharge the water between parts or portions of the rib or flange on the opposite sides the second communication hole.

The refrigerator may further include (i) a case having a water supply hole therein and (ii) a water supply pipe connected to the water supply hole, and the first communication hole may be aligned with the water supply hole.

The water flowing from the first communication hole to the second communication hole may be discharged through the second communication hole after contacting the rib or flange.

A lower portion of the rib or flange may be spaced apart from a lowermost edge of the second communication hole by a preset distance, and the water may flow through a space between the lowermost edge of the second communication hole and the lower portion of the rib or flange.

In accordance with another aspect of the present invention, there is provided an ice maker (e.g., for a refrigerator, configured to make ice), comprising an ice tray configured to contain water; a guide unit under the ice tray, forming a path for flowing cold air; an ice bucket under the guide unit, comprising a container having a concave center portion; a rotation unit configured to move the ice in the ice tray to the ice bucket; a cover unit configured to cover the ice tray, and a case with a water supply hole at one side, wherein the cover unit has a water supply unit corresponding to the water supply hole, and the water supply unit includes a first communication hole aligned with the water supply hole; a water supply wall corresponding to the ice tray; and a second communication hole on the water supply wall, wherein one side of the water supply wall is configured to shield part of the second communication hole.

The water supply wall may be configured to change a direction of the water (e.g., supplied through and/or from the first communication hole) when the water contacts a part of the water supply wall configured to shield the second communication hole.

The water supply wall may extend and/or protrude to shield opposite sides of the second communication hole.

The water supply wall may be further configured to pass water (e.g., supplied through and/or from the first communication hole) to a center of the second communication hole and supply the water to the ice tray.

According to an embodiment of the present invention, an ice maker that can effectively make ice and a refrigerator having the same can be provided.

In addition, an ice maker that can prevent a water supply defect and a refrigerator having the same can be provided.

DETAILED DESCRIPTION

Figure 1:
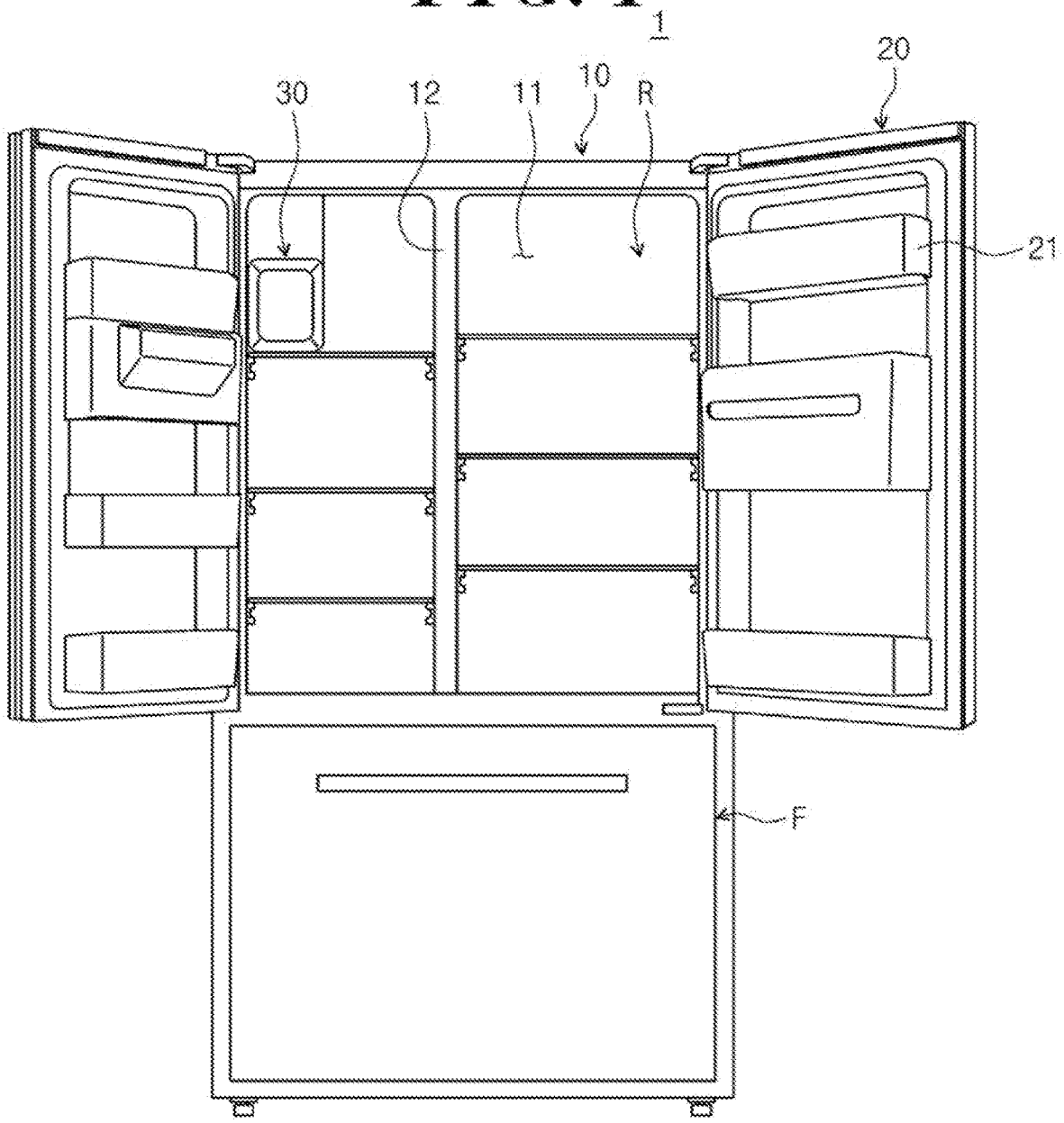
FIG. 1 is a perspective view showing an exemplary refrigerator according to one or more embodiments of the present invention.

Hereinafter, embodiments of the present invention will be described in more detail with reference to the accompanying drawings. The disclosed embodiments may be modified in a variety of forms, and the scope of the present invention should not be limited to the embodiments described below. The embodiments are provided to explain the present invention to those skilled in the art. Accordingly, the shapes of the elements in the drawing may be exaggerated to emphasize more clear descriptions.

FIG. 1 is a perspective view showing a refrigerator according to one or more embodiments of the present invention.

Referring to FIG. 1, a refrigerator 1 according to one or more embodiments of the present invention may include a main body 10 and one or more doors 20.

Hereinafter, the direction from the rear side to the front side of the refrigerator 1 is referred to as a thickness direction, the direction from one side surface to another side surface of the refrigerator 1 is referred to as a width direction, and the direction from the bottom surface to the top surface of the refrigerator 1 is referred to as a height direction. The door(s) 20 are at the front of the refrigerator 1, and the icemaker 30 is adjacent to the top surface of the refrigerator 1.

The main body 10 provides and/or defines the overall external shape of the refrigerator 1. At least one storage room 11 may be inside the main body 10. The storage room(s) 11 inside the main body 10 may be partitioned by a barrier 12. The storage room(s) 11 may include one or more refrigeration rooms R and one or more freezer rooms F. For example, the refrigeration room(s) R may be at or in the upper part of the main body 10, and the freezer room(s) F may be at or in the lower part of the main body 10.

At least one door 20 is on the main body 10. The door 20 opens and closes the storage room 11. For example, the door 20 is hingedly or pivotally fixed to the main body 10 to rotate and may open and close the storage room 11 as it rotates with respect to the main body 10. The number of doors 20 may correspond to the number of partitions of the storage room 11. For example, doors 20 are provided in front of the refrigeration room(s) R and the freezer room(s) F, respectively, and may individually open and close a corresponding one of the refrigeration room R and the freezer room F. For example, two doors 20 may be provided in front of the refrigeration room R on the left and right sides of the refrigerator 1. One or more shelves 21 may be provided on the inside surface of the door 20.

An ice maker 30 may be at or on one side of one storage room 11. For example, the ice maker 30 may be in one refrigeration room R and/or at the upper part of one of the storage rooms 11. Alternatively, the ice maker 30 may be in one door 20 or in the freezer room F.

Figure 2:
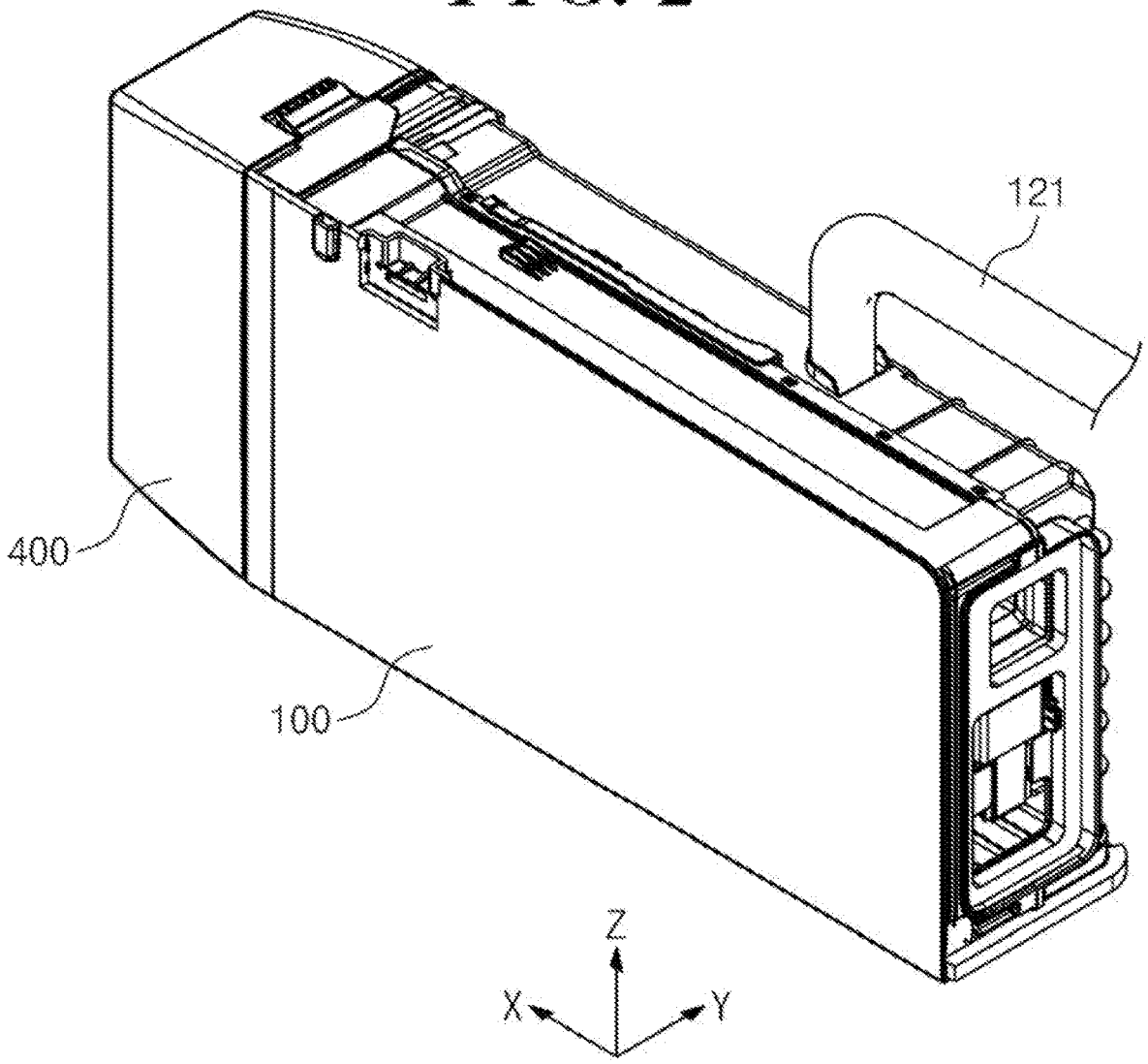
FIG. 2 is a perspective view showing an exemplary ice maker suitable for the refrigerator of FIG. 1.
Figure 3:
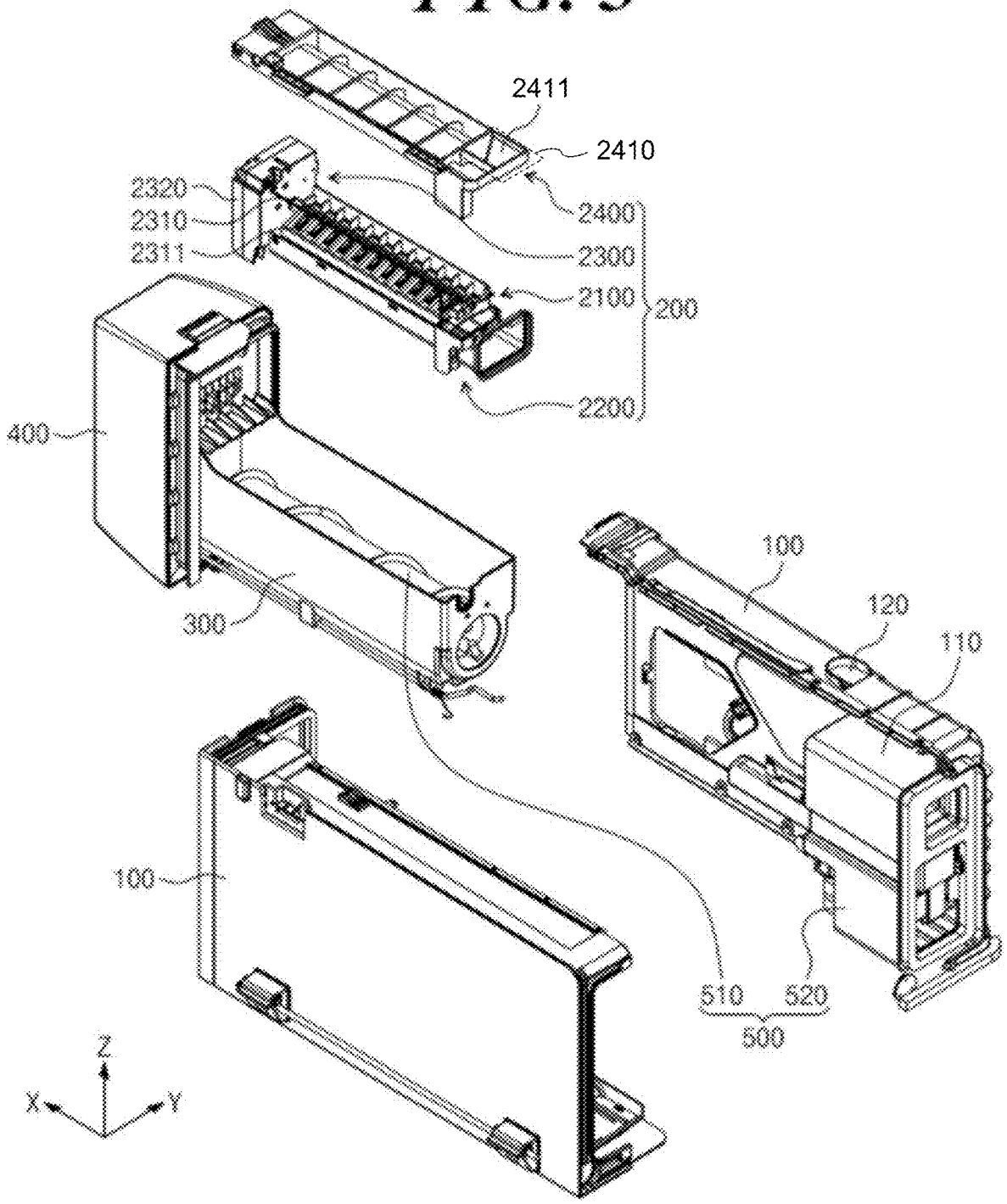
FIG. 3 is an exploded perspective view showing the ice maker of FIG. 2.
Figure 4:
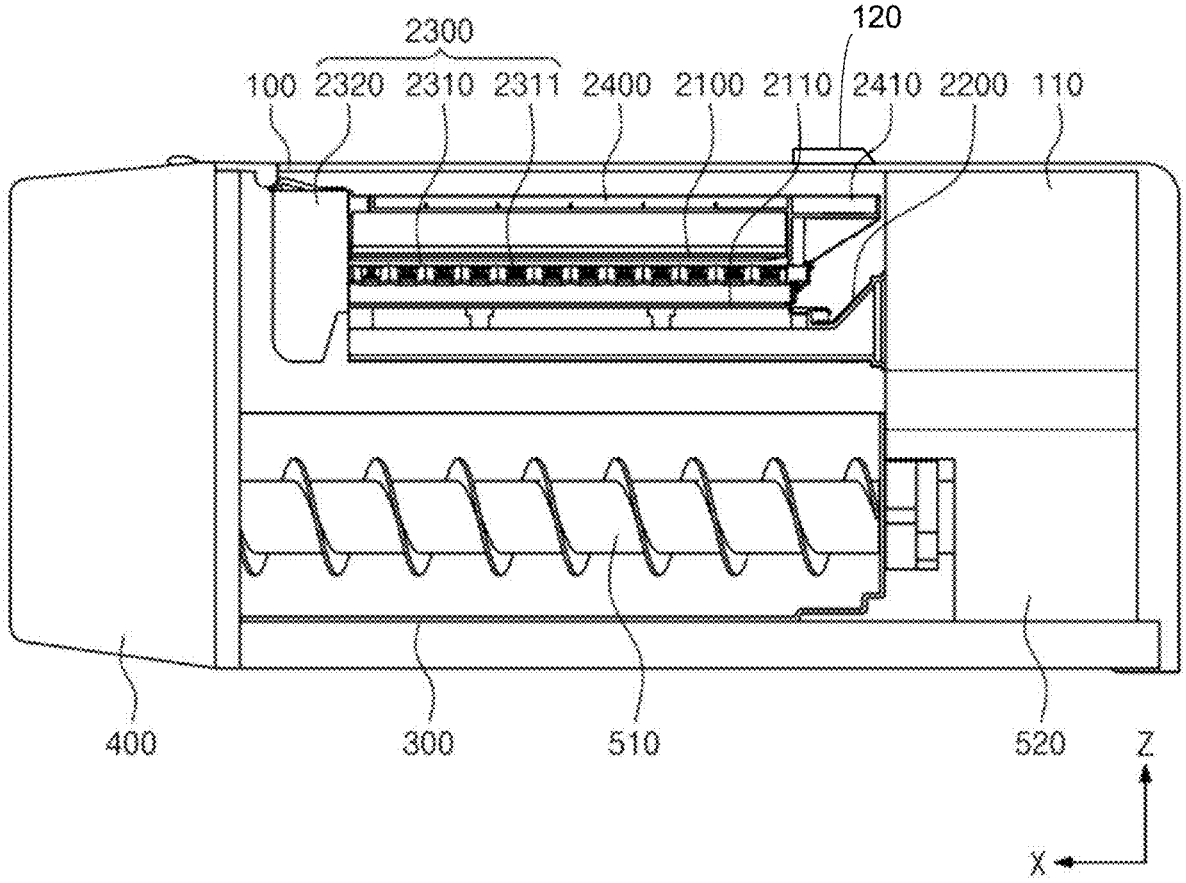
FIG. 4 is a side cross-sectional view of the ice maker of FIG. 2.
Figure 5:
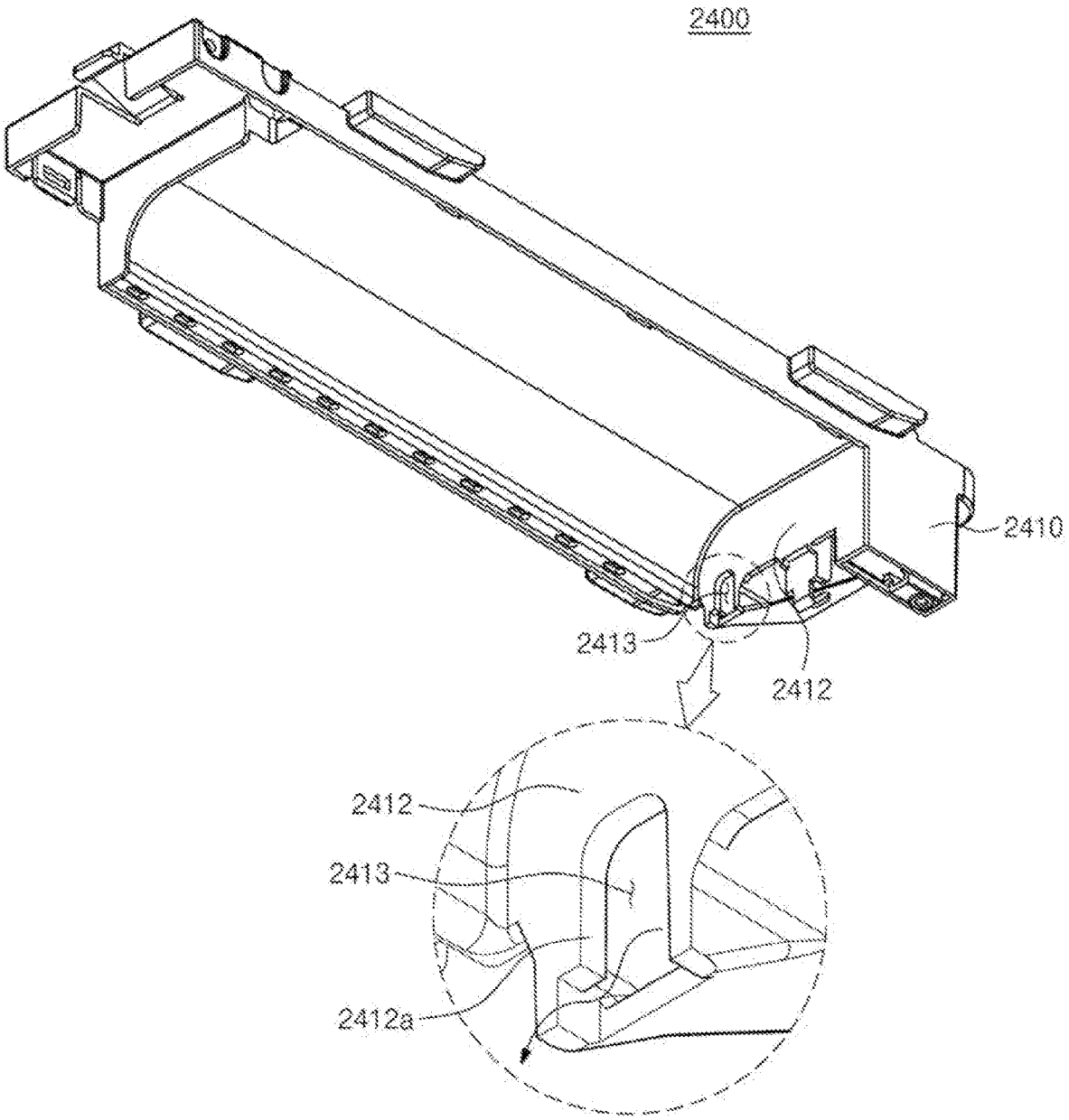
FIG. 5 is a perspective view showing an exemplary cover unit suitable for the ice maker of FIG. 2 viewed from an underside.

FIG. 2 is a perspective view showing an ice maker suitable for the refrigerator 1 of FIG. 1, FIG. 3 is an exploded perspective view showing the ice maker of FIG. 2, FIG. 4 is a side cross-sectional view of the ice maker of FIG. 2, and FIG. 5 is a perspective view showing a cover unit suitable for the ice maker of FIG. 2 viewed from an underside.

Referring to FIGS. 2 to 5, the ice maker 30 may include a case 100, an ice making assembly 200, an ice bucket 300, a discharge unit 400 and a transfer unit 500.

The ice maker 30 may make and store ice.

Hereinafter, the direction from a cold air duct 110 to the discharge unit 400 is referred to as a first direction X, a direction perpendicular to the first direction X (e.g., a horizontal direction and/or in a plane) is referred to as a second direction Y, and the vertical direction perpendicular to both the first direction X and the second direction Y is referred to as a third direction Z. In addition, a side on which the discharge unit 400 is located is referred to as a front side, and a side on which the cold air duct 110 is located is referred to as a rear side.

The external shape of the ice maker 30 may be defined in part by the case 100. The case 100 may have a preset volume and a space for accommodating constitutional components of the ice maker 30 therein. The case 100 may be fixed at a point inside the storage room 11 or inside the door 20.

The ice making assembly 200 may make ice by exchanging heat of or in the water with cold air. The ice making assembly 200 may include an ice tray 2100, a guide unit 2200, a rotation unit 2300 and a cover unit 2400.

The ice tray 2100 is configured to contain water. The water in the ice tray 2100 becomes ice through heat exchange with cold air. The ice tray 2100 comprises a container, having a center portion that is concave downwards (e.g., U-shaped), and a space and/or preset volume for containing water may be on or in the ice tray 2100. For example, the ice tray 2100 may comprise a multi-compartment container, each compartment being configured to hold a predetermined volume of liquid water and optionally having a convex lower surface, in which the center of each compartment has a greater depth than along the sidewalls of each compartment. The ice tray 2100 may have a preset length along the first direction X and a preset width in the second direction Y. For example, the ice tray 2100 may be rectangular as seen from the top (e.g., in a plan view).

A heater 2110 may be under the ice tray 2100. The heater 2110 may contact the bottom surface of the ice tray 2100 at least at one point. When the ice made in the ice tray 2100 is transferred to the ice bucket 300 by the rotation unit 2300, the heater 2110 may heat the bottom surface of the ice tray 2100 so that the ice may be effectively separated from the ice tray 2100.

The guide unit 2200 may be under the ice tray 2100. The guide unit 2200 forms a path for flowing cold air onto and/or around the ice tray 2100. The cold air flowing between the guide unit 2200 and the ice tray 2100 cools down the ice tray 2100 to freeze the water in the ice tray 2100. The guide unit 2200 may have a preset length in the first direction X and a preset width in the second direction Y. The guide unit 2200 may contact the ice tray 2100 at least at one point and may support the ice tray 2100. The rear end of the guide unit 2200 in the first direction X may communicate with the cold air duct 110 that supplies the cold air. The guide unit 2200 may be fixed to the inside surface of the case 100 or to the cold air duct 110.

The rotation unit 2300 moves the ice in the ice tray 2100 to the ice bucket 300. The rotation unit 2300 may include an ice removing shaft 2310 and a drive housing 2320.

As the ice removing shaft 2310 rotates, the ice in the ice tray 2100 is moved to the outside of the ice tray 2100. The ice removing shaft 2310 has a preset length and may be in a space above the ice tray 2100. The length of the ice removing shaft 2310 may in or along the first direction X. One or more ice removing prominences 2311 may be along the ice removing shaft 2310. The ice removing prominence(s) 2311 may extend from the outer surface of the ice removing shaft 2310 toward the outside by a preset length. The ice removing prominence(s) 2311 may not contact the water in the ice tray 2100 when the rotation unit 2300 is in a standby state (i.e., not in an operational state). When the ice removing shaft 2310 rotates for transfer of the ice, the ice removing prominence(s) 2311 may push the ice out of the ice tray 2100.

A drive unit (e.g., motor) inside the drive housing 2320 provides power for rotating the ice removing shaft 2310. The drive housing 2320 may be located at one side of the ice tray 2100 along or with respect to the first direction X. The drive housing 2320 may be located on the opposite side of the ice removing shaft 2310 from the cold air duct 110. One end of the ice removing shaft 2310 may be inserted into the drive housing 2320 by a preset length and connected to the driving unit (e.g., a motor) inside the drive housing 2320.

The cover unit 2400 may be on or over the ice tray 2100 in or along the third direction Z. The cover unit 2400 may cover all or part of the ice tray 2100. The cover unit 2400 may have a preset length in the first direction X and a preset width in the second direction Y. The width of the cover unit 2400 may correspond to the width of the guide unit 2200 or may be larger than the width of the guide unit 2200 by a set width. Accordingly, the ice tray 2100 may be between the cold air guide unit 2200 and the cover unit 2400. The front end of the cover unit 2400 may contact the top of the drive housing 2320. The cover unit 2400 may be fixed to the inner surface of the case 2410 at least at one point.

A water supply unit 2410 may be at the rear end of the cover unit 2400. The water supply unit 2410 supplies water from an external source to the ice tray 2100. For example, a water supply hole 120 connected to a water supply pipe 121 may be at one side of the case 100. In addition, the water supply unit 2410 may be aligned with the water supply hole 120, and the water flowing through the water supply hole 120 may be supplied to the water supply unit 2410.

Specifically, the water supply unit 2410 of the cover unit 2400 may include a first communication hole 2411, a water supply wall 2412, and a second communication hole 2413.

The first communication hole 2411 communicates with the water supply hole 120 of the case 100 and may be connected to the water supply hole 120 through the water supply pipe 121. The water supplied to the water supply unit 2410 through the first communication hole 2411 may be discharged from the water supply unit 2410 through the second communication hole 2413. The water discharged from the water supply unit 2410 may be supplied to the ice tray 2100.

The second communication hole 2413 may be at one side of the water supply wall 2412 of the water supply unit 2410. The water supply wall 2412 may be at one side or end of the ice tray 2100. Specifically, the water supply wall 2412 may be adjacent to a water-containing space in the ice tray 2100. Accordingly, the water from the second communication hole 2413 may be supplied to the ice tray 2100.

A rib or flange 2412*a* may be on the water supply wall 2412. The rib or flange 2412*a* may be adjacent to one or more sides of the second communication hole 2413. For example, the rib or flange 2412*a* may extend from the water supply wall 2412 adjacent to the edge of the second communication hole 2413. The rib or flange 2412*a* may have an area smaller than that of the second communication hole 2413. The rib or flange 2412*a* may be in an area at or adjacent to the edge of the water supply wall 2412 (e.g., at an interface with the second communication hole 2413). Accordingly, the water supplied through the second communication hole 2413 may be discharged through the second communication hole 2413 after contacting the rib or flange 2412*a*. That is, the direction of the water flowing from the first communication hole 2411 to the second communication hole 2413 may change to the center of the second communication hole 2413. Accordingly, the water supplied from the second communication hole 2413 may not leak to the outside of the ice tray 2100. The lower (e.g., horizontal) portion of the rib or flange 2412*a* may be spaced apart from the lowermost part of the second communication hole 2413 by a preset distance. Accordingly, a space for guiding the water to flow downwards (e.g., into the ice tray 2100) may be in the lowermost part of the second communication hole 2413, below the lower (e.g., horizontal) portion of the rib or flange 2412*a*.

The ice bucket 300 is under the ice making assembly 200 and contains ice supplied from the ice making assembly 200. The ice bucket 300 may have a preset length along the first direction X and a preset width in the second direction Y. The ice bucket 300 may comprise a container having a center portion that is concave downwards (e.g., U-shaped), and the ice bucket may include a preset volume for containing ice. As seen from the top along the third direction Z, at least part of the ice bucket 300 is positioned outside the ice tray 2100 in the width direction, and the ice supplied from the ice tray 2100 may be contained in the ice bucket 300.

The discharge unit 400 may be at an end of the ice bucket 300. The discharge unit 400 discharges the ice in the ice bucket 300 to the outside of the ice maker 30 (e.g., through the corresponding door 20; see FIG. 1). The discharge unit 400 may be coupled or connected to the front end of the ice bucket 300. The discharge unit 400 may be outside the case 100. The discharge unit 400 has a width corresponding to the case 100 in the second direction Y and a height corresponding to the case 100 in the third direction Z and may shield the case 100. The discharge unit 400 may be detachable from the case 100. Accordingly, if the user separates the discharge unit 400 from the case 100 and moves the discharge unit 400 forward (e.g., out of the corresponding storage space), the ice bucket 300 may be exposed to the outside of the case 100.

The transfer unit 500 moves the ice in the ice bucket 300 to the discharge unit 400. The transfer unit 500 includes a transfer shaft 510 and a transfer housing 520.

As the transfer shaft 510 rotates, the ice in the ice bucket 300 moves to the discharge unit 400. The transfer shaft 510 has a preset length and may be in the lower part or portion of the ice bucket 300. The transfer shaft 510 may have a length or rotational axis in or along the first direction X. For example, the transfer shaft 510 may be or comprise an auger.

The transfer housing 520 houses a motor that provides power for rotating the transfer shaft 510. The transfer housing 520 may be at one side of the ice bucket 300 in or along the first direction X. The transfer housing 520 may be on the opposite side of the ice bucket 300 from the discharge unit 400. The transfer shaft 510 is coupled or connected to the transfer housing 520 or the motor therein, and may rotate by the power provided by the motor in the transfer housing 520.

Hereinafter, an ice maker and a refrigerator having the same according to another embodiment of the present invention will be described with reference to FIG. 6. However, since the embodiment of FIG. 6 is different from the embodiment of FIG. 5 in that a second rib or flange 2412*b*' is further included, it will be described focusing on the difference, and the descriptions and reference symbols of the embodiment of FIG. 5 will be cited for the like portions.

Figure 6:
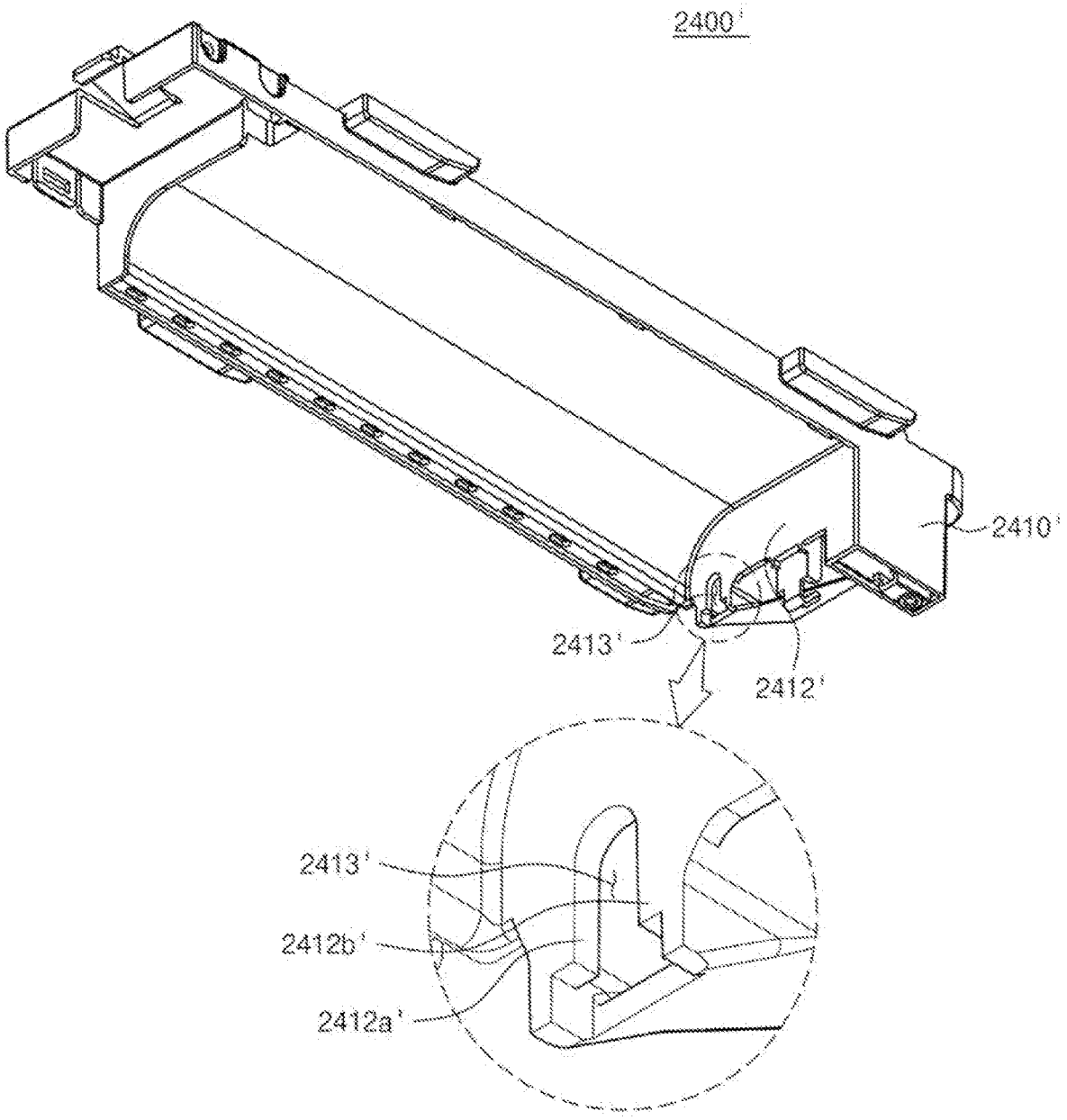
FIG. 6 is a perspective view showing an alternative cover unit suitable for an ice maker according to another embodiment of the present invention.

FIG. 6 is a perspective view showing an alternative cover unit for an ice maker according to another embodiment of the present invention.

Referring to FIG. 6, a plurality of ribs or flanges 2412*a*' and 2412*b*' may be on a water supply wall 2412' of a water supply unit 2410'. Specifically, a second communication hole 2413' may be in the water supply wall 2412', and a first rib or flange 2412*a*' and a second rib or flange 2412*b*' may be on opposite sides of the second communication hole 2413', respectively. Alternatively, a single, continuous rib or flange may be adjacent to the second communication hole 2413' and/or at the interface between the water supply wall 2412' and the second communication hole 2413'. Accordingly, substantially the entire periphery of the second communication hole 2413' may be surrounded and/or protected by the first rib or flange 2412*a*' and the second rib or flange 2412*b*' (e.g., other than the notches in the lowermost part of the second communication hole 2413' below the horizontal portions of the first and second ribs or flanges 2412*a*' and 2412*b*'). That is, the water supply wall 2412' may be extended orthogonally to the peripheral edge of the second communication hole 2413'. The lower (e.g., horizontal) portion of the first rib or flange 2412*a*' may be spaced apart from the lowermost part of the second communication hole 2413' by a preset distance, and a space for guiding the water to flow downwards may be formed between the lowermost part of the second communication hole 2413' and the lower (e.g., horizontal) portion of the first rib or flange 2412*a*'. The lower (e.g., horizontal) portion of the second rib or flange 2412*b*' may be spaced apart from the lowermost edge of the second communication hole 2413' by a preset distance (e.g., the height of the notch), and a space for guiding the water to flow downwards may be between the lowermost edge of the second communication hole 2413' and the lower (e.g., horizontal) portion of the second rib or flange 2412*b*'.

The water flowing from the first communication hole 2411' to the second communication hole 2413' may contact the first rib or flange 2412*a*' and the second rib or flange 2412*b*' and change direction to the center of the second communication hole 2413'. Accordingly, the water drains from the center of the second communication hole 2413', between the first rib or flange 2412*a*' and the second rib or flange 2412*b*', and leakage of the water to the outside of the ice tray 2100 can be prevented.

According to an embodiment of the present invention, an ice maker that can effectively make ice and a refrigerator having the same can be provided.

In addition, an ice maker that can prevent a water supply defect and a refrigerator having the same can be provided.

The above detailed description provides examples of the present invention. In addition, the above description explains by showing preferred embodiments of the present invention, and the present invention may be used in various different combinations, changes and environments. That is, the present invention may be modified or changed within the scope of the spirit of the present invention disclosed in this specification, within a scope equivalent to the disclosed contents, and/or within the scope of the technique(s) or knowledge of the prior art. The above embodiments describe the best conditions for implementing the technical spirit of the present invention, and various changes in the specific application fields and usages of the present invention also can be made. Accordingly, the detailed description of the present invention as described above shows disclosed embodiments and is not intended to limit the present invention. In addition, the appended claims should be interpreted as also including other embodiments.

What is claimed is:

1. A refrigerator comprising:
- a main body having a storage room therein;
- a door on the main body, configured to open and close the storage room; and
- an ice maker in the storage room, wherein the ice maker includes:
  - an ice tray configured to contain water;
  - a guide unit under the ice tray, forming a path for flowing cold air;
  - an ice bucket under the guide unit, comprising a container having a concave center portion;
  - a rotation unit configured to move the ice in the ice tray to the ice bucket; and
  - a cover unit configured to cover the ice tray and having a water supply unit configured to supply water to the ice tray, wherein the water supply unit includes:
    - a first communication hole in the cover unit;
    - a water supply wall on one side of the ice tray;
    - first and second side walls orthogonal to the water supply wall; and
    - a second communication hole in the water supply wall, communicating with the first communication hole and configured to discharge the water,
    - wherein a lower portion of the water supply wall extends from at least one of the first and second side walls by a preset distance.

2. The refrigerator according to claim 1, wherein the lower portion of the water supply wall extends from both of the first and second side walls.

3. The refrigerator according to claim 2, wherein the water supply wall is configured to discharge the water between the first and second side walls.

4. The refrigerator according to claim 1, further comprising (i) a case having a water supply hole therein and (ii) a water supply pipe connected to the water supply hole.

5. The refrigerator according to claim 4, wherein the first communication hole is aligned with the water supply hole.

6. The refrigerator according to claim 1, wherein the second communication hole is configured to discharge the water after the water contacts the lower portion of the water supply wall.

7. The refrigerator according to claim 1, wherein the water flows through a space between the lowermost edge of the second communication hole and the lower portion of the water supply wall.

8. An ice maker, comprising:
- an ice tray configured to contain water;
- a guide unit under the ice tray, forming a path for flowing cold air;
- an ice bucket under the guide unit, comprising a container having a concave center portion;
- a rotation unit configured to move the ice in the ice tray to the ice bucket;
- a cover unit configured to cover the ice tray and having a water supply unit configured to supply water to the ice tray, and
- a case including a water supply hole at one side and a water supply pipe connected to the water supply hole wherein the water supply unit includes:
  - a first communication hole aligned with the water supply hole;
  - a water supply wall corresponding to the ice tray; and
  - first and second side walls orthogonal to the water supply wall; and a second communication hole in the water supply wall, communicating with the first communication hole and configured to discharge the water, wherein the water supply wall comprises a lower portion that extends from at least one of the first and second side walls by a first preset distance.

9. The ice maker according to claim 8, wherein the lower portion extends from both of the first and second side walls.

10. The ice maker according to claim 9, wherein the water supply wall is further configured to pass the water through a center of the second communication hole and supply the water to the ice tray.

11. The ice maker according to claim 9, wherein the lower portion of the water supply wall is spaced apart from a lowermost edge of the second communication hole by a second preset distance.

* * * * *